US009910398B2

(12) United States Patent
Inagaki et al.

(10) Patent No.: US 9,910,398 B2
(45) Date of Patent: Mar. 6, 2018

(54) ELECTROPHOTOGRAPHIC IMAGE FORMING APPARATUS CONTAINING ORGANIC PHOTORECEPTOR, UNIT FOR SUPPLYING LUBRICANT, AND CLEANING BLADE

(71) Applicant: Konica Minolta, Inc., Tokyo (JP)

(72) Inventors: Keiichi Inagaki, Hino (JP); Seijiro Takahashi, Kokubunji (JP); Hiroshi Nakahara, Hachioji (JP); Hiroshige Kidera, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/255,411

(22) Filed: Sep. 2, 2016

(65) Prior Publication Data

US 2017/0082970 A1 Mar. 23, 2017

(30) Foreign Application Priority Data

Sep. 18, 2015 (JP) ..... 2015-184645

(51) Int. Cl.
*G03G 21/00* (2006.01)
*G03G 5/05* (2006.01)

(52) U.S. Cl.
CPC ..... *G03G 21/0094* (2013.01); *G03G 5/05* (2013.01); *G03G 21/0011* (2013.01)

(58) Field of Classification Search
CPC ... G03G 21/0094; G03G 5/05; G03G 21/0011
USPC ..... 399/346
See application file for complete search history.

(56) References Cited

U.S. PATENT DOCUMENTS

2012/0328347 A1* 12/2012 Kashiwakura ..... G03G 21/0094 399/346
2013/0137029 A1* 5/2013 Kadonome ..... G03G 9/08 430/105

FOREIGN PATENT DOCUMENTS

JP 2005-070306 A 3/2005
JP 2005234282 A * 9/2005
JP 2006-106649 A 4/2006
JP 2007-121918 A 5/2007
(Continued)

OTHER PUBLICATIONS

Notice of Reasons for Rejection dated Dec. 19, 2017 from corresponding Japanese Patent Application No. 2015-184645 and English translation.

*Primary Examiner* — Billy Lactaoen
(74) *Attorney, Agent, or Firm* — Lucas & Mercanti, LLP

(57) ABSTRACT

An electrophotographic image forming apparatus using an organic photoreceptor in which at least a charge generation layer, a charge transport layer, and a protective layer are laminated in order on a conductive support includes at least a unit for supplying a lubricant onto a surface of the organic photoreceptor and a unit for removing toner remaining on the surface of the organic photoreceptor with a cleaning blade, and satisfying the following conditions (1) to (3): (1) the protective layer of the organic photoreceptor contains at least metal oxide fine particles in a cured resin obtained by curing a polymerizable compound; (2) a universal hardness of the surface of the organic photoreceptor is in a range of 220 to 280 N/mm$^2$; and (3) a JIS-A hardness of a portion of the cleaning blade to be abutted on the organic photoreceptor is in a range of 70 to 78°.

5 Claims, 3 Drawing Sheets

(56) References Cited

FOREIGN PATENT DOCUMENTS

| | | | |
|---|---|---|---|
| JP | 2008046198 | A | 2/2008 |
| JP | 2011-128282 | A | 6/2011 |
| JP | 2013257504 | A | 12/2013 |
| JP | 2014-002312 | A | 1/2014 |
| JP | 2014-235276 | A | 12/2014 |
| JP | 2015-114454 | A | 6/2015 |

* cited by examiner

ELECTROPHOTOGRAPHIC IMAGE FORMING APPARATUS CONTAINING ORGANIC PHOTORECEPTOR, UNIT FOR SUPPLYING LUBRICANT, AND CLEANING BLADE

The entire disclosure of Japanese Patent Application No. 2015-184645 filed on Sep. 18, 2015 including description, claims, drawings, and abstract are incorporated herein by reference in its entirety.

BACKGROUND OF THE INVENTION

Field of the Invention

The present invention relates to an electrophotographic image forming apparatus. More specifically, the present invention relates to an electrophotographic image forming apparatus that can prevent the occurrence of image deletion, raindrop-like spots, and slipping-through of toner and can maintain cleanability for the long term.

Description of the Related Art

In an electrophotographic image forming apparatus, the surface of a charged organic photoreceptor (hereinafter, also referred to as "photoreceptor") is exposed to light to form an electrostatic latent image, and then toner is supplied to develop the electrostatic latent image, and the resulting image is transferred onto paper. After transfer, a cleaning blade is abutted on the surface of the photoreceptor to remove the toner remaining on the photoreceptor. Long-term maintenance of high cleanability of the photoreceptor leads to high reliability and durability of the image forming apparatus.

For example, a photoreceptor is known which has a protective layer provided on the surface thereof to prevent the wear of the surface caused by contact with a cleaning means such as a blade to maintain cleanability for the long term (see, for example, JP 2008-046198 A).

Further, a protective layer particularly excellent in wear resistance is known which contains metal oxide fine particles whose surface has been modified with a surface modifier having a reactive organic group in a cross-linkable cured resin obtained by curing a polymerizable compound (see, for example, JP 2013-257504 A).

Although such a protective layer has excellent wear resistance and can prolong the lifetime of a photoreceptor, a discharge product or paper dust is likely to accumulate on the protective layer so that surface resistance is reduced. This may cause so-called image deletion.

At present, a known effective means for preventing image deletion is to reduce the film strength of the surface of a photoreceptor so that the surface of the photoreceptor can be scraped off by a cleaning means, such as a blade, during use. However, if the film strength of the surface of the photoreceptor is reduced, toner fine particles or the like are pressed against the surface of the photoreceptor drum when slipping through the blade so that the toner fine particles are likely to firmly adhere to the surface of the photoreceptor drum. Further, areas where the toner fine particles are firmly adhered act as cores to block exposure light for forming a latent image, and as a result, there is a case where white spots, that is, so-called raindrop-like spots appear in an image.

Even when the hardness of the blade is increased to prevent the formation of cores that cause raindrop-like spots, scratches (surface irregularities) are formed on the surface of the photoreceptor by such a hard blade, which makes the contact between the blade and the surface of the photoreceptor poor. As a result, there is a case where slipping-through of toner occurs.

For this reason, there has been a demand for a photoreceptor that can maintain cleanability for the long term and can prevent the occurrence of image deletion, raindrop-like spots, and slipping-through of toner.

SUMMARY OF THE INVENTION

In view of the above problems and circumstances, it is an object of the present invention to provide an electrophotographic image forming apparatus that can prevent the occurrence of image deletion, raindrop-like spots, and slipping-through of toner and can maintain cleanability for the long term.

In order to achieve the above object, the present inventors have studied the causes of the above problems, and as a result have found that the occurrence of image deletion, raindrop-like spots, and slipping-through of toner can be prevented and cleanability can be maintained for the long term by increasing the hardness of the surface of a protective layer of a photoreceptor and the hardness of a cleaning blade so that an appropriate combination of these hardnesses is achieved. This finding has led to the completion of the present invention.

More specifically, the above object of the present invention is achieved by the following means.

1. To achieve the abovementioned object, according to an aspect, an electrophotographic image forming apparatus using an organic photoreceptor in which at least a charge generation layer, a charge transport layer, and a protective layer are laminated in order on a conductive support, reflecting one aspect of the present invention comprises at least a unit for supplying a lubricant onto a surface of the organic photoreceptor and a unit for removing toner remaining on the surface of the organic photoreceptor with a cleaning blade, and satisfying the following conditions (1) to (3):

(1) the protective layer of the organic photoreceptor contains at least metal oxide fine particles in a cured resin obtained by curing a polymerizable compound;

(2) a universal hardness of the surface of the organic photoreceptor is in a range of 220 to 280 $N/mm^2$; and (3) a JIS-A hardness of a portion of the cleaning blade to be abutted on the organic photoreceptor is in a range of 70 to 78°.

2. The electrophotographic image forming apparatus according to Item. 1, wherein the protective layer preferably contains a radical scavenger having a structure represented by the following general formula (1).

[Chemical Formula 1]

General Formula (1)

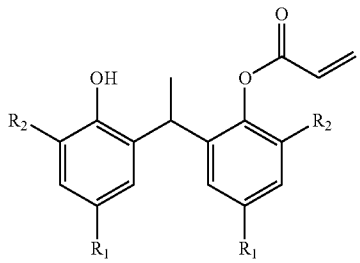

[wherein $R_1$ and $R_2$ are each an alkyl group having 1 to 6 carbon atoms.]

3. The electrophotographic image forming apparatus according to Item. 1 or 2, wherein the cleaning blade preferably abuts on the organic photoreceptor at an angle of 5 to 20° and a linear pressure of 13 to 24 N/m.

4. The electrophotographic image forming apparatus according to any one of Items. 1 to 3, wherein the lubricant preferably contains zinc stearate.

5. The electrophotographic image forming apparatus according to any one of Items. 1 to 4, wherein the unit for supplying a lubricant is preferably a unit for supplying, to the organic photoreceptor, the fine powdery lubricant externally added to the toner by action of a development field formed by a unit for forming a toner image.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
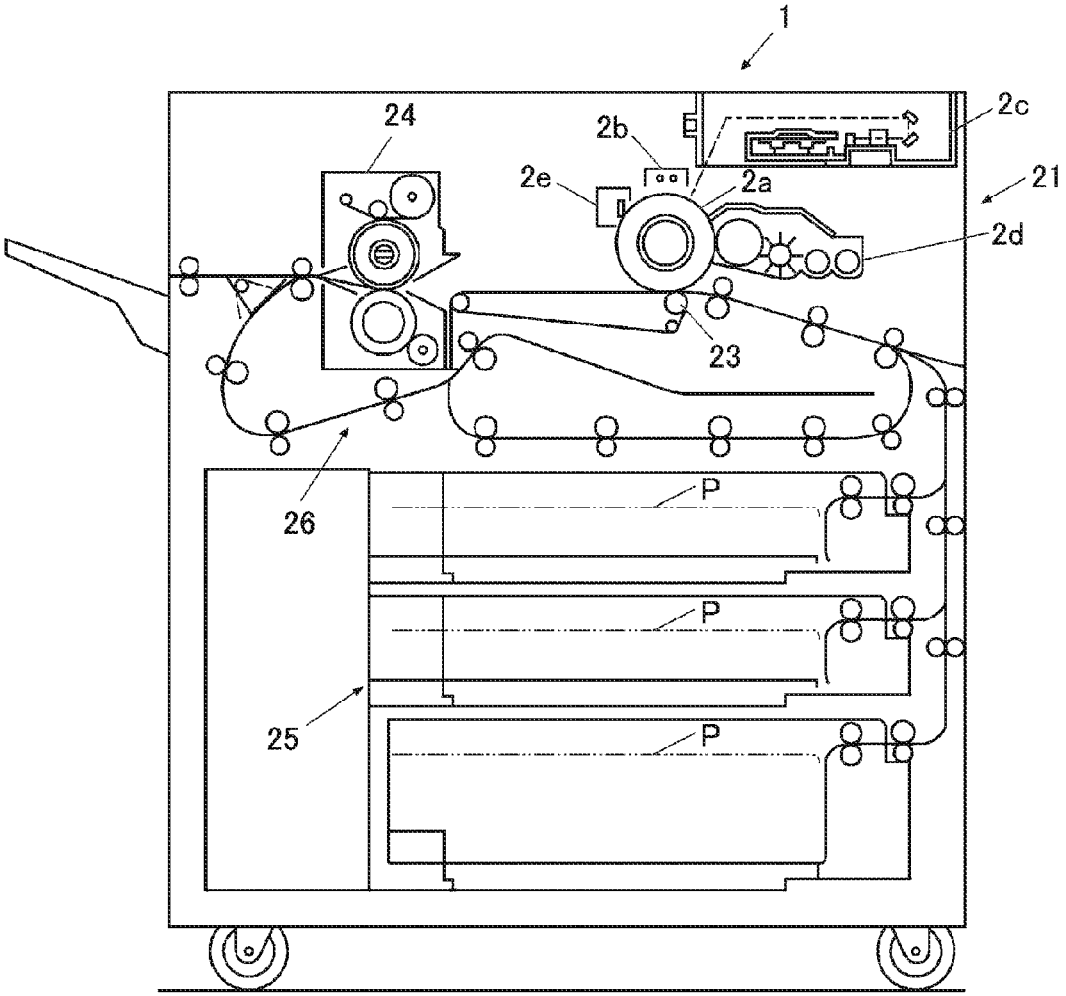
FIG. 1 is a front elevational view schematically showing the structure of an electrophotographic image forming apparatus according to an embodiment of the present invention.

Hereinafter, an embodiment of the present invention will be described with reference to the drawings. However, the scope of the invention is not limited to the illustrated examples.

An electrophotographic image forming apparatus according to the present invention is an electrophotographic image forming apparatus using an organic photoreceptor in which at least a charge generation layer, a charge transport layer, and a protective layer are laminated in order on a conductive support, the electrophotographic image forming apparatus including at least a means for supplying a lubricant onto a surface of the organic photoreceptor and a means for removing toner remaining on the surface of the organic photoreceptor with a cleaning blade, and satisfying the above-described conditions (1) to (3). This is a technical feature common to the inventions according to Items. 1 to 5.

According to a preferred embodiment of the present invention, the protective layer contains a radical scavenger having a structure represented by the above general formula (1). The radical scavenger can control the cross-linking reaction of the polymerizable compound during the formation of the protective layer, and therefore the universal hardness of the surface of the photoreceptor can be easily adjusted to be within the range of 220 to 280 N/mm$^2$ by controlling the cross-linking density of the polymer (film strength of a cured film).

According to a preferred embodiment of the present invention, from the viewpoint of enhancing the power of scraping residual toner and achieving higher cleanability, the cleaning blade abuts on the organic photoreceptor at an angle of 5 to 20° and a linear pressure of 13 to 24 N/m.

According to a preferred embodiment of the present invention, from the viewpoint of cleanability as a lubricant, availability, and cost, the lubricant to be contained is zinc stearate.

According to a preferred embodiment of the present invention, from the viewpoint of stably supplying the lubricant for the long term, the means for supplying a lubricant is a means for supplying, to the organic photoreceptor, the fine powdery lubricant externally added to the toner by action of a development field formed by a means for forming a toner image.

Hereinbelow, the present invention, components thereof, and embodiments and aspects for carrying out the present invention will be described in detail.

It is to be noted that "to" between numerical values used in this application means a range including the numerical values described before and after "to" as a lower limit and an upper limit.

[Electrophotographic Image forming Apparatus]

An electrophotographic image forming apparatus 1 according to the present invention is an electrophotographic image forming apparatus 1 using an organic photoreceptor 2*a* in which at least a charge generation layer, a charge transport layer, and a protective layer are laminated in order on a conductive support, the electrophotographic image forming apparatus 1 including at least a means for supplying a lubricant onto a surface of the organic photoreceptor 2*a* and a means for removing toner remaining on the surface of the organic photoreceptor 2*a* with a cleaning blade 51, and satisfying the following conditions (1) to (3): (1) the protective layer of the organic photoreceptor 2*a* contains at least metal oxide fine particles in a cured resin obtained by curing a polymerizable compound; (2) a universal hardness of the surface of the organic photoreceptor 2*a* is in a range of 220 to 280 N/mm$^2$; and (3) a JIS-A hardness of a portion of the cleaning blade 51 to be abutted on the organic photoreceptor 2*a* is in a range of 70 to 78°.

FIG. 1 schematically shows the structure of the electrophotographic image forming apparatus 1 according to an embodiment of the present invention (hereinafter, sometimes simply referred to as "image forming apparatus").

As shown in FIG. 1, the image forming apparatus 1 includes a writing unit 21, a transfer roller 23, a fixing device 24, and a paper feed tray 25.

The writing unit 21 includes the drum-shaped photoreceptor 2*a*, a charging section 2*b* disposed in the rotational direction of the photoreceptor 2*a*, an exposure section 2*c*, a developing section 2*d*, and a cleaning device 2*e*.

In the writing unit 21 during image formation, a uniform potential is applied to the photoreceptor 2*a* by the charging section 2*b* to charge the photoreceptor 2*a*, and then the surface of the photoreceptor 2*a* is scanned with a luminous flux emitted from the exposure section 2*c* based on original image data to form an electrostatic latent image. The exposure section 2*c* is configured to have a polygon mirror that deflects a luminous flux emitted from a light source such as an LED and an optical system that guides the luminous flux to the photoreceptor 2*a*.

Then, the developing section 2*d* supplies toner onto the photoreceptor 2*a*. The photoreceptor 2*a* carries an image developed with the supplied toner.

Paper P is fed from the paper feed tray 25 in accordance with the timing when the image carried on the photoreceptor 2*a* reaches the position of the transfer roller 23 by the rotation of the photoreceptor 2*a* so that the image on the photoreceptor 2*a* is transferred onto the paper P nipped between the transfer roller 23 and the photoreceptor 2*a*.

After transfer, the toner remaining on the photoreceptor 2*a* is removed by the cleaning device 2*e*.

Then, the paper P onto which the image has been transferred is heated and pressed by the fixing device 24 to fix the image onto the paper P. When images are to be formed on both surfaces of the paper P, the paper P is transported to a transport route 26 to turn over the paper P, and then the paper P is again fed to the position of the transfer roller 23.

Figure 2:
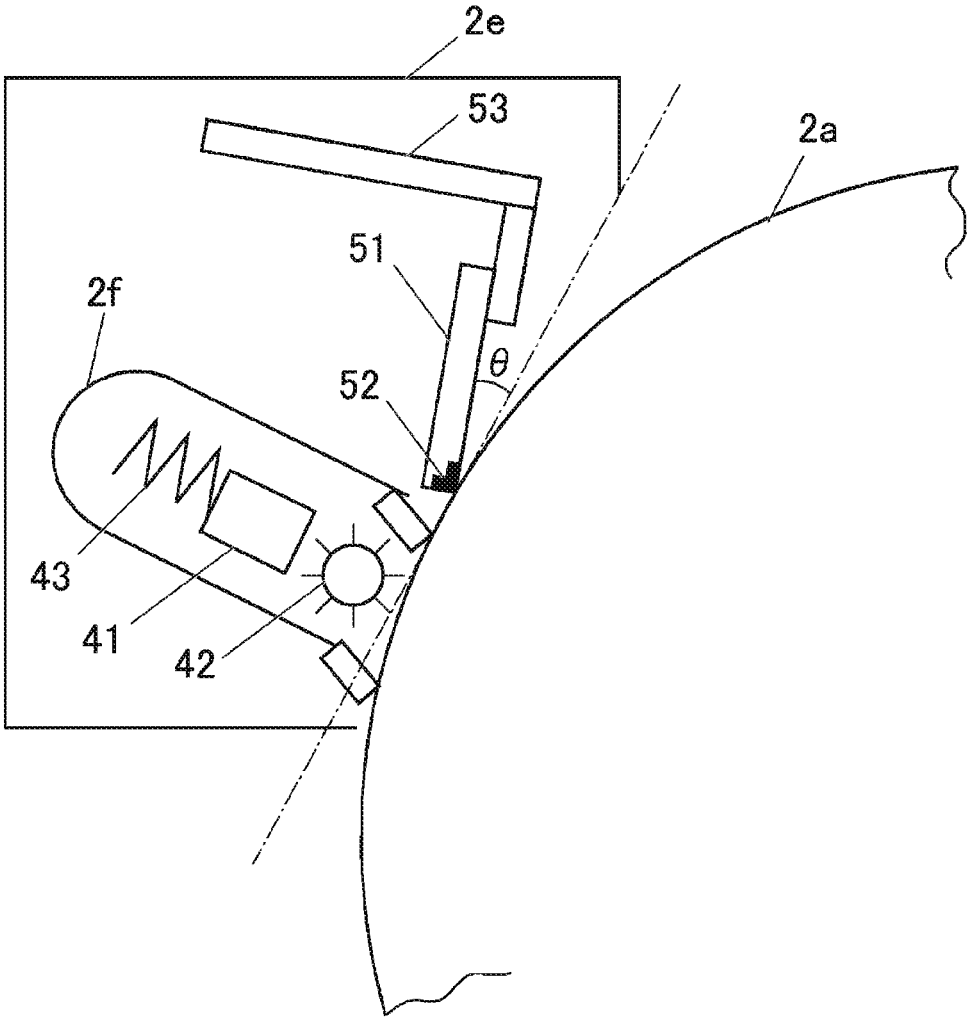
FIG. 2 is an enlarged view of part of a photoreceptor on which a cleaning blade is abutted.

FIG. 2 is an enlarged view of part of the photoreceptor 2*a* near the cleaning device 2*e*.

As shown in FIG. 2, the cleaning device 2*e* includes the cleaning blade 51 that abuts on the surface of the photoreceptor 2*a* to remove the toner remaining on the photoreceptor 2*a*.

The surface of the photoreceptor 2*a* has a universal hardness (HU) in the range of 220 to 280 N/mm$^2$. A portion of the cleaning blade 51 to be abutted on the photoreceptor 2*a* has a JIS-A hardness in the range of 70 to 78°.

The surface of the photoreceptor 2*a* has a universal hardness (HU) as high as 220 N/mm$^2$ or more, and the cleaning blade to be used has an appropriate JIS-A hardness in the range of 70 to 78°. Therefore, the amount of bite of the cleaning blade 51 is small so that the cleaning blade 51 is less likely to stick. This makes it possible to effectively prevent slipping-through of toner so that cores that cause raindrop-like spots are less likely to be formed. Therefore, the occurrence of raindrop-like spots can also be prevented.

If the universal hardness (HU) of the surface of the photoreceptor 2*a* is excessively high, a discharge product or paper dust accumulated on the surface of the protective layer and a hydrophilic deteriorated layer formed by oxidation of the outermost surface of the protective layer cannot be removed by the cleaning blade 51 so that image deletion occurs. The universal hardness (HU) of the surface of the photoreceptor 2*a* according to the present invention is set to 280 N/mm$^2$ or less so as not to be excessively high, which makes it possible to prevent the occurrence of image deletion.

If the JIS-A hardness of the cleaning blade 51 is excessively high, scratches (surface irregularities) are formed on the surface of the photoreceptor 2*a*, which makes the contact between the blade and the surface of the photoreceptor poor. As a result, slipping-through of toner occurs. The JIS-A hardness of the cleaning blade 51 according to the present invention is set to 78° or less so as not to be excessively high, which makes it possible to prevent slipping-through of toner.

The JIS-A hardness of the cleaning blade 51 refers to a value measured at 25° C. using a type A durometer in accordance with a hardness test method specified in JIS K6253.

Examples of a material used for the cleaning blade 51 include polyurethane, silicone rubber, fluorine-containing rubber, chloroprene rubber, and butadiene rubber. Among them, from the viewpoint of achieving such appropriate strength and flexibility that the cleaning blade 51 can abut on the rotary photoreceptor 2*a*, polyurethane is preferred.

The cleaning blade 51 using polyurethane can be produced by, for example, mixing a dehydrated polyol and an isocyanate compound, reacting the resulting mixture at a temperature of 100 to 120° C. for 30 to 90 minutes to obtain a prepolymer, adding a cross-linking agent to the prepolymer, injecting the prepolymer into a die, and curing the prepolymer.

Examples of the polyol to be used include polyester polyols such as polyethylene adipate and polycaprolactone, and examples of the isocyanate compound to be used include diphenylmethane diisocyanate and the like. Examples of the cross-linking agent to be used include 1,4-butanediol, trimethylol propane, ethylene glycol, and mixtures of two or more of them.

The cleaning blade 51 maybe configured so that the entirety thereof has a JIS-A hardness in the above range. Alternatively, the cleaning blade 51 may be configured to have a cured layer 52 having a JIS-A hardness within the above range in its portion to be abutted on the photoreceptor 2*a* (see FIG. 2). When the cleaning blade 51 has the high-hardness cured layer 52 only in its portion to be abutted on the photoreceptor 2*a*, the hardness of the main body of the cleaning blade 51 can be easily adjusted to achieve such flexibility that the cleaning blade 51 can be appropriately bent when abutting on the photoreceptor 2*a*.

The cured layer 52 may be a layer provided on the surface of the cleaning blade 51. However, from the viewpoint of enhancing durability, the cured layer 52 is preferably a layer provided by processing part of the main body of the cleaning blade 51.

When polyurethane is used as a base material of the cleaning blade 51, a portion of the cleaning blade 51 to be abutted on the photoreceptor 2*a* is immersed in an isocyanate compound for a certain time to react polyurethane contained in the main body of the cleaning blade 51 with an isocyanate compound, which makes it possible to form a cured layer 52 in the portion where the reaction has occurred.

The cured layer 52 formed in the above manner contains a polymer of the polyurethane and the isocyanate compound. In the polyurethane constituting the cleaning blade 51, a urethane bond having an active hydrogen is present. Therefore, a reaction between the urethane bond and the isocyanate compound in which the cleaning blade 51 is immersed makes it possible to form an allophanate bond, which increases the hardness of the cured layer 52, between the polyurethane contained in the cleaning blade 51 and the polymer contained in the cured layer 52. Further, a multimerization reaction of the isocyanate compound in which the cleaning blade 51 is immersed also proceeds at the same time so that the formed cured layer 52 can have a large thickness. Therefore, even when the cured layer 52 wears off, the cleaning blade 51 can maintain an appropriate JIS-A hardness for the long term due to the large thickness of the cured layer 52.

From the viewpoint of enhancing the power of scraping residual toner and achieving higher cleanability, as shown in FIG. 2, the cleaning blade 51 preferably abuts on the photoreceptor 2*a* at an angle θ of inclination to the surface of the photoreceptor 2*a* of 5 to 20° and a linear pressure of 13 to 24 N/m.

From the viewpoint of reducing friction between the photoreceptor 2*a* and the cleaning blade 51 to prolong the lifetimes of both of them, as shown in FIG. 2, the cleaning device 2*e* preferably has a lubricant supply section 2*f* disposed in the rotational direction of the photoreceptor 2*a*.

The lubricant supply section 2*f* supplies, onto the surface of the photoreceptor 2*a*, lubricant particles scraped off from a solid lubricant 41, biased by a pressure member 43, with a brush roller 42.

Alternatively, the developing section 2*d* may be used as the lubricant supply section 2*f*. In this case, a fine powdery lubricant externally added to toner maybe supplied onto the surface of the photoreceptor 2*a* by action of a development field formed in a developing step in the developing section 2*d*. When a lubricant is supplied with the brush roller 42, there is a case where the ability of the brush roller 42 to supply the lubricant is reduced by the wear of the brush roller 42 or dirt adhered to the brush roller 42. However, in the case of the method in which a lubricant is supplied by action of a development field, the lubricant can be stably supplied for the longer term.

The fine powdery lubricant externally added to toner is not particularly limited as long as the fine powdery lubricant has lubricity and cleavability. However, from the viewpoint of cleanability as a lubricant, availability, and cost, zinc stearate or the like is preferably used.

The number-average primary particle size of the lubricant is preferably, for example, 1 to 20 μm. The lubricant is preferably added to toner at a rate of 0.01 to 0.3 mass % so as not to affect the charging characteristics of the toner.

[Organic Photoreceptor]

Figure 3:
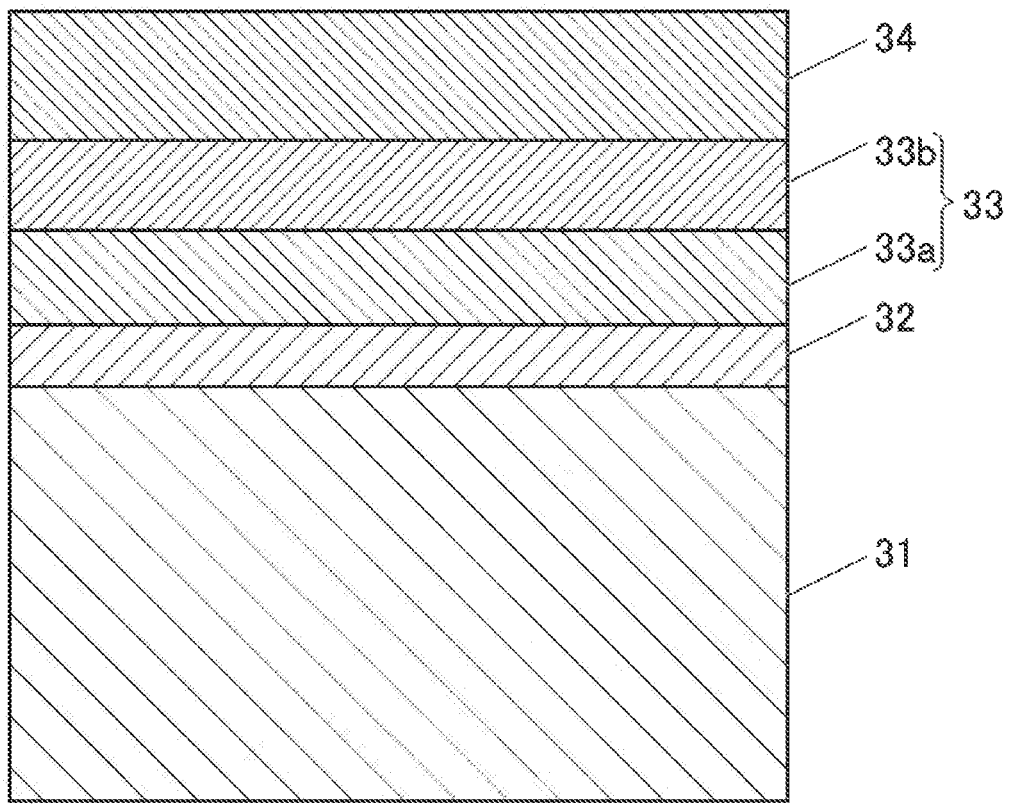
FIG. 3 is a sectional view showing the structure of the photoreceptor.

The organic photoreceptor according to the present invention has a layer structure in which at least an organic photosensitive layer 33, including a charge generation layer 33*a* and a charge transport layer 33*b*, and a protective layer 34 are laminated in order on a conductive support 31 (see FIG. 3). The protective layer 34 contains at least a cured polymer of a polymerizable compound and metal oxide particles, and the surface of the organic photoreceptor (protective layer 34) has a universal hardness of 220 to 280 $N/mm^2$.

In the present invention, the universal hardness of the protective layer as a surface of the organic photoreceptor is a value measured by an ultramicro hardness test system "Fischer Scope H100" (hardness test system manufactured by Fischer Instruments in accordance with ISO/FDIS14577).

More specifically, in Fischer Scope H100, a load F(N) (maximum load: 2 mN) is applied stepwise to a square pyramidal diamond indenter having a specified face angle of 136° to push the indenter into a sample to determine an indentation depth h (mm). From the indentation depth h and the load F, a universal hardness (HU) is calculated by the following formula.

$$HU(N/mm^2)=F/(26.45\times h^2)$$

Further, the photoreceptor according to the present invention may be configured to have an intermediate layer 32 provided between the conductive support 31 and the charge generation layer 33*a* (see FIG. 3). Further, the organic photosensitive layer may be a single layer containing a charge generation material and a charge transport material.

In the present invention, the organic photoreceptor means an electrophotographic photoreceptor containing an organic compound having at least one of a charge generation function and a charge transport function essential to the structure of the electrophotographic photoreceptor, and includes a known organic photoreceptor such as a photoreceptor composed of a known organic charge generation material or organic charge transport material or a photoreceptor composed of a polymer complex having a charge generation function and a charge transport function.

<Protective Layer>

The protective layer constituting the photoreceptor according to the present invention is provided as the outermost surface of the photoreceptor from the viewpoint of protecting the photoreceptor from an external force. As described above, the protective layer as a surface of the photoreceptor has a universal hardness of 220 to 280 $N/mm^2$.

The layer thickness of the protective layer is preferably 0.2 to 10 μm, more preferably 0.5 to 6 μm.

The protective layer contains at least metal oxide fine particles in a cured resin obtained by curing a polymerizable compound. From the viewpoint of setting the hardness of the protective layer to a universal hardness within the above range, a polymerization reaction for obtaining the cured resin is preferably performed in the presence of a specific radical scavenger. The use of a specific radical scavenger makes it possible to control a cross-linking reaction during a polymerization reaction and therefore to control the cross-linking density of a polymer (film strength of cured film).

(Cured Resin Component)

The cured resin component constituting the protective layer is obtained by polymerizing and curing a polymerizable compound by irradiation with actinic rays such as ultraviolet rays or electron beams. The polymerizable compound to be used is a monomer having two or more polymerizable functional groups (polyfunctional polymerizable compound). The monomer having two or more polymerizable functional groups may be used in combination with a monomer having one polymerizable functional group (monofunctional polymerizable compound). Specific examples of the polymerizable compound include styrene-based monomers, acrylic monomers, methacrylic monomers, vinyltoluene-based monomers, vinyl acetate-based monomers, and N-vinylpyrrolidone-based monomers.

The polymerizable compound is particularly preferably an acrylic monomer having two or more acryloyl groups ($CH_2{=}CHCO{-}$) or methacryloyl groups ($CH_2{=}CCH_3CO{-}$) or an oligomer thereof, because curing can be performed with a small amount of light or in a short time.

In the present invention, these polymerizable compounds may be used singly or in combination of two or more of them. Further, these polymerizable compounds may be used in the form of monomer or oligomer.

Specific examples of the polymerizable compound are shown below.

[Chemical Formula 2]

M1

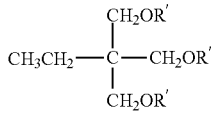

M2

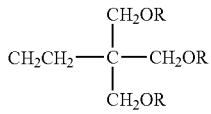

M3

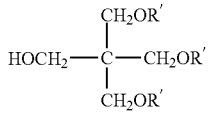

M4

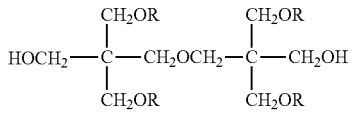

M5

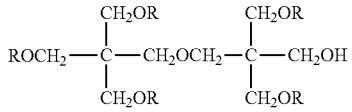

-continued

M6

$CH_3CH_2C-(CH_2OC_3H_2OR)_3$

M7

$CH_2CH_2C-(CH_2CH_2OR)_3$

M8

$R-(OC_3H_2)_3-OR$

M9

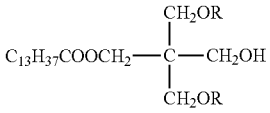

M10

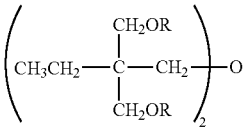

M11

$(ROCH_2)_4-C$

M12

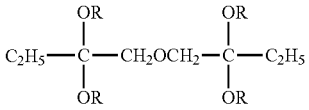

M13

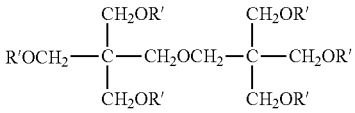

M14

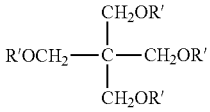

In the above chemical formulas representing exemplary compounds (M1) to (M14), R is an acryloyl group ($CH_2{=}CHCO-$) and R' is a methacryloyl group ($CH_2{=}CCH_3CO-$).

The polymerizable compound to be used is preferably a monomer having three or more polymerizable functional groups. As the polymerizable compound, two or more compounds may be used in combination. Also in this case, however, a monomer having three or more polymerizable functional groups is preferably used at a rate of 50 mass % or more.

(Metal Oxide Fine Particles)

The metal oxide fine particles are intended to enhance the strength of the protective layer or to achieve resistance adjustment that contributes to the stability of image quality.

Examples of the metal oxide fine particles to be used to constitute the protective layer include silica (silicon oxide), magnesium oxide, zinc oxide, lead oxide, alumina (aluminum oxide), zirconium oxide, tin oxide, titania (titanium oxide), niobium oxide, molybdenum oxide, and vanadium oxide. Among them, tin oxide is preferred from the viewpoint of electrical characteristics.

The metal oxide fine particles are not particularly limited, and may be particles produced by a known production method.

The number-average primary particle diameter of the metal oxide fine particles is preferably 1 to 300 nm, more preferably 3 to 100 nm, even more preferably 5 to 40 nm.

In the present invention, the number-average primary particle diameter of the metal oxide fine particles was determined in the following manner. An enlarged photograph of the metal oxide fine particles was taken through a scanning electron microscope (manufactured by JEOL Ltd.) at a magnification of 10000, and an image of the photograph was captured by a scanner. Then, the 300 metal oxide fine particles (except for aggregated particles) were randomly selected, and their number-average primary particle diameter was determined by analyzing the photographic image with the use of an automatic image analyzer "LUZEX AP (software version: Ver. 1.32)" (manufactured by NIRECO CORPORATION).

The metal oxide fine particles may be those having a surface modified with a surface modifier having a reactive organic group (hereinafter, also referred to as "reactive organic group-containing surface modifier"). More specifically, metal oxide fine particles as a raw material (hereinafter, also referred to as "untreated metal oxide fine particles") are surface-modified with a reactive organic group-containing surface modifier so that a reactive organic group is introduced onto the surface of the untreated metal oxide fine particles.

The reactive organic group-containing surface modifier is preferably one that reacts with a hydroxyl group or the like present on the surface of the metal oxide fine particles. Examples of such a reactive organic group-containing surface modifier include a silane coupling agent and a titanium coupling agent.

The reactive organic group-containing surface modifier is preferably one having a radical polymerizable reactive group. Examples of the radical polymerizable reactive group include a vinyl group, an acryloyl group, and a methacryloyl group. Such a radical polymerizable reactive group can react also with the polymerizable compound according to the present invention to form a strong protective layer. The surface modifier having a radical polymerizable reactive group is preferably a silane coupling agent having a radical polymerizable reactive group such as a vinyl group, an acryloyl group, or a methacryloyl group.

Specific examples of the reactive organic group-containing surface modifier are shown below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)\ COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$

S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Alternatively, the reactive organic group-containing surface modifier may be a silane compound having a radical polymerizable reactive organic group other than the above exemplary compounds (S-1) to (S-36).

These reactive organic group-containing surface modifiers may be used singly or in combination of two or more of them.

The amount of the reactive organic group-containing surface modifier to be used is preferably 0.1 to 200 parts by mass, more preferably 7 to 70 parts by mass per 100 parts by mass of the untreated metal oxide fine particles.

A method for treating the unreacted metal oxide fine particles with the reactive organic group-containing surface modifier may be, for example, a method in which a slurry containing the untreated metal oxide fine particles and the reactive organic group-containing surface modifier (suspension of solid particles) is subjected to wet grinding. In this method, reaggregation of the untreated metal oxide fine particles is prevented while the surface modification of the untreated metal oxide fine particles proceeds. Then, a solvent is removed to obtain a powder.

A surface modifying apparatus may be, for example, a wet media dispersion-type apparatus. The wet media dispersion-type apparatus is an apparatus including the step of grinding aggregated particles of untreated metal oxide fine particles and dispersing the untreated metal oxide fine particles by rotating a stirring disk attached perpendicular to a rotating shaft at high speed in a container filled with beads as media. The structure of the wet media dispersion-type apparatus is not particularly limited as long as untreated metal oxide fine particles can be sufficiently dispersed during surface modification of the untreated metal oxide fine particles and the surface of the untreated metal oxide fine particles can be modified. Various types of wet media dispersion-type apparatuses maybe used, such as vertical type, horizontal type, continuous type, and batch type. More specifically, a sand mill, Ultra Visco Mill, a pearl mill, a grain mill, DYNO-MILL, an agitator mill, a dynamic mill, or the like may be used. These dispersion-type apparatuses perform fine grinding and dispersion using grinding media (media) such as balls or beads by impact crush, friction, shear, shear stress, or the like.

The beads to be used in the wet media dispersion-type apparatus maybe balls using, as a raw material, glass, alumina, zircon, zirconia, steel, flint, or the like, but are particularly preferably made of zirconia or zircon. Usually, beads having a diameter of about 1 to 2 mm are used. However, in the present invention, beads having a diameter of about 0.1 to 1.0 mm are preferably used.

The disk or the inner wall of the container for use in the wet media dispersion-type apparatus may be made of any material such as stainless steel, nylon, or ceramic. However, in the present invention, the disk or the inner wall of the container are particularly preferably made of ceramic such as zirconia or silicon carbide.

(Radical Scavenger)

The above-described polymerizable compound is preferably polymerized in the presence of a specific radical scavenger represented by the following general formula (1). This specific radical scavenger functions as an agent for stopping cross-linking. That is, cross-linking density (film strength of cured film) can be adjusted by controlling the addition rate of the specific radical scavenger. Therefore, when the cured resin component is obtained by polymerizing the polymerizable compound in the presence of a specific radical scavenger, the protective layer has an appropriate film strength (wear resistance) so that the surface of the photoreceptor is appropriately worn away by a cleaning means such as a blade. Therefore, even when a discharge product is adhered to the surface of the photoreceptor, the surface of the photoreceptor is refreshed by wear so that image deletion can be prevented.

[Chemical Formula 4]

General Formula (1)

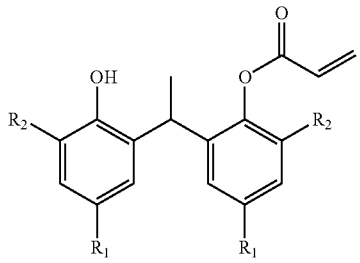

wherein $R_1$ and $R_2$ are each an alkyl group having 1 to 6 carbon atoms. When $R_1$ and $R_2$ are each an alkyl group having 1 to 6 carbon atoms, the influence of steric hindrance of the radical scavenger can be reduced to appropriately control a cross-linking reaction. From the viewpoint of the stability of scavenged radicals, $R_1$ and $R_2$ are each preferably a tert-butyl group or a tert-pentyl group.

(Other Components)

The protective layer may further contain other components such as a charge transport material, an antioxidant, and lubricant particles.

The charge transport material to be used is preferably, for example, a compound represented by the following general formula (2).

[Chemical Formula 5]

General Formula (2)

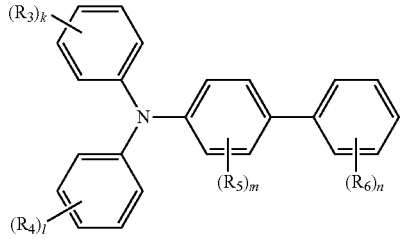

wherein $R_3$, $R_4$, $R_5$, and $R_6$ are each a hydrogen atom, an alkyl group having 1 to 7 carbon atoms, or an alkoxy group having 1 to 7 carbon atoms, and k, l, and n are each an integer of 1 to 5 and m is an integer of 1 to 4. When k, l, n, or m is 2 or more, two or more $R_3$s, $R_4$s, $R_5$s, or $R_6$s may be the same or different from each other.

The compound represented by the general formula (2) may be, for example, one disclosed in JP 2015-114454 A.

Alternatively, the compound represented by the general formula (2) may be synthesized by a known synthesis method such as a method disclosed in JP 2006-143720 A.

The antioxidant to be used may be, for example, one described in JP 2000-305291 A.

As the lubricant particles, particles made of a fluorine atom-containing resin may be added. The fluorine atom-containing resin is preferably at least one appropriately selected from a tetrafluoroethylene resin, a trifluorochloroethylene resin, a hexafluorochloroethylene propylene resin, a vinyl fluoride resin, a vinylidene fluoride resin, a difluorodichloroethylene resin, and a copolymer of two or more of them. Among them, a tetrafluoroethylene resin and a vinylidene fluoride resin are particularly preferred.

Hereinbelow, the components of the photoreceptor other than the protective layer will be described.

[Conductive Support]

The conductive support constituting the photoreceptor according to the present invention is not particularly limited as long as the conductive support has conductivity. Examples of the conductive support include one obtained by forming a metal such as aluminum, copper, chromium, nickel, zinc, or stainless steel into a drum or sheet shape, one obtained by laminating a metal foil such as an aluminum foil or a copper foil on a plastic film, one obtained by evaporating aluminum, indium oxide, tin oxide, or the like onto a plastic film, and a metal or plastic film or a sheet of paper having a conductive layer formed by applying a conductive material singly or in combination with a binder resin.

[Intermediate Layer]

The photoreceptor according to the present invention may have an intermediate layer provided between the conductive support and the organic photosensitive layer and having a barrier function and an adhesive function. In consideration of preventing various failures, the intermediate layer is preferably provided.

Such an intermediate layer is, for example, one containing a binder resin (hereinafter, also referred to as "binder resin for intermediate layer") and, if necessary, conductive particles or metal oxide particles.

Examples of the binder resin for intermediate layer include casein, polyvinyl alcohol, nitrocellulose, ethylene-acrylic acid copolymers, polyamide resins, polyurethane resins, and gelatin. Among them, an alcohol-soluble polyamide resin is preferred.

The intermediate layer may contain various conductive particles or metal oxide particles for the purpose of adjusting resistance. For example, various metal oxide particles such as alumina, zinc oxide, titanium oxide, tin oxide, antimony oxide, indium oxide, bismuth oxide, and the like may be used. Ultrafine particles such as tin-doped indium oxide, antimony-doped tin oxide, and zirconium oxide may be used.

The number-average primary particle diameter of the metal oxide particles is preferably 0.3 μm or less, more preferably 0.1 μm or less.

These metal oxide particles may be used singly or in combination of two or more kinds of them. When two or more kinds of metal oxide particles are used in combination, two or more kinds of metal oxides may be in the form of solid solution or fusion.

The content of the conductive particles or metal oxide particles is preferably 20 to 400 parts by mass, more preferably 50 to 350 parts by mass per 100 parts by mass of the binder resin.

The layer thickness of the intermediate layer is preferably 0.1 to 15 μm, more preferably 0.3 to 10 μm.

[Charge Generation Layer]

The charge generation layer in the organic photosensitive layer constituting the photoreceptor according to the present invention contains a charge generation material and a binder resin (hereinafter, also referred to as "binder resin for charge generation layer).

Examples of the charge generation material include, but are not limited to, azo pigments such as Sudan Red and Dian Blue, quinone pigments such as pyrene quinone and anthanthrone, quinocyanine pigments, perylene pigments, indigo pigments such as indigo and thioindigo, polycyclic quinone pigments such as pyranthrone and diphthaloylpyrene, and phthalocyanine pigments. Among them, polycyclic quinone pigments and titanyl phthalocyanine pigments are preferred. These charge generation materials may be used singly or in combination of two or more of them.

The binder resin for charge generation layer to be used may be a known resin, and examples thereof include, but are not limited to, a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, a copolymer resin containing two or more of these resins (e.g., vinyl chloride-vinyl acetate copolymer resin, vinyl chloride-vinyl acetate-maleic anhydride copolymer resin), and a poly-vinylcarbazole resin. Among them, a polyvinyl butyral resin is preferred.

The content of the charge generation material in the charge generation layer is preferably 1 to 600 parts by mass, more preferably 50 to 500 parts by mass per 100 parts by mass of the binder resin for charge generation layer.

The layer thickness of the charge generation layer varies depending on the characteristics of the charge generation material, the characteristics of the binder resin for charge generation layer, or the content of the charge generation material, but is preferably 0.01 to 5 μm, more preferably 0.05 to 3 μm.

[Charge Transport Layer]

The charge transport layer in the organic photosensitive layer constituting the photoreceptor according to the present invention contains a charge transport material and a binder resin (hereinafter, also referred to as "binder resin for charge transport layer).

Examples of the charge transport material contained in the charge transport layer as a material that transports an electric charge (hole) include triphenylamine derivatives, hydrazone compounds, styryl compounds, benzidine compounds, and butadiene compounds.

The charge transport layer formed under the protective layer preferably contains a charge transport material that has a high mobility and a high molecular weight. Such a charge transport material is preferably one different from the compound represented by the above general formula (2).

The binder resin for charge transport layer to be used may be a known resin, and examples thereof include a polycarbonate resin, a polyacrylate resin, a polyester resin, a polystyrene resin, a styrene-acrylonitrile copolymer resin, a polymethacrylate resin, and a styrene-methacrylate copolymer resin. Among them, a polycarbonate resin is preferred. From the viewpoint of crack resistance, wear resistance, and charging characteristics, a polycarbonate resin is preferred, such as a BPA (bisphenol A)-, BPZ (bisphenol Z)-, dimethyl BPA-, or BPA-dimethyl BPA copolymer-type polycarbonate resin.

The content of the charge transport material in the charge transport layer is preferably 10 to 500 parts by mass, more preferably 20 to 250 parts by mass per 100 parts by mass of the binder resin for charge transport layer.

The layer thickness of the charge transport layer varies depending on the characteristics of the charge transport material, the characteristics of the binder resin for charge transport layer, or the content of the charge transport material, but is preferably 5 to 40 μm, more preferably 10 to 30 μm.

The charge transport layer may contain an antioxidant, an electronic conductive agent, a stabilizer, or silicone oil. The antioxidant is preferably one disclosed in, for example, JP 2000-305291 A, and the electronic conductive agent is preferably one disclosed in, for example, JP 50-137543 A or JP 58-76483 A.

[Method for Producing Organic Photoreceptor]

Specifically, a method for producing the photoreceptor according to the present invention includes the following steps of: (1) applying a coating liquid for forming an intermediate layer onto an outer periphery of a conductive support and drying the coating liquid to form an intermediate layer; (2) applying a coating liquid for forming a charge generation layer onto an outer periphery of the intermediate layer formed on the conductive support and drying the coating liquid to form a charge generation layer; (3) applying a coating liquid for forming a charge transport layer onto an outer periphery of the charge generation layer formed on the intermediate layer and drying the coating liquid to form a charge transport layer; and (4) applying a coating liquid for forming a protective layer onto an outer periphery of the charge transport layer formed on the charge generation layer to form a protective layer by polymerization and curing.

[Step (1): Formation of Intermediate Layer]

An intermediate layer can be formed in the following manner. A coating liquid (hereinafter, also referred to as "coating liquid for forming an intermediate layer") is prepared by dissolving a binder resin for intermediate layer in a solvent, and if necessary, conductive particles or metal oxide particles are dispersed in the coating liquid. Then, the coating liquid is applied onto a conductive support to form a coating film having a uniform layer thickness, and the coating film is dried to form an intermediate layer.

Examples of a method for applying the coating liquid for forming an intermediate layer include known methods such as immersion coating, spray coating, spinner coating, bead coating, blade coating, beam coating, slide hopper coating, and circular slide hopper coating.

A method for drying the coating film can be appropriately selected depending on the type of solvent used or the layer thickness, but is preferably heat drying.

The solvent used in the step of forming an intermediate layer is preferably one that well disperses the conductive fine particles or the metal oxide fine particles and dissolves the binder resin for intermediate layer, especially a polyamide resin. More specifically, from the viewpoint of excellent solubility of a polyamide resin and coatability, an alcohol having 1 to 4 carbon atoms is preferred, such as methanol, ethanol, n-propyl alcohol, isopropyl alcohol, n-butanol, t-butanol, or sec-butanol. The solvent may be used in combination with a co-solvent to improve storage stability and particle dispersibility. Examples of the co-solvent used to obtain such an advantageous effect include benzyl alcohol, toluene, dichloromethane, cyclohexanone, and tetrahydrofuran.

The concentration of the binder resin for intermediate layer in the coating liquid for forming an intermediate layer is appropriately selected depending on the layer thickness of the intermediate layer or a production speed.

Examples of a means for dispersing the conductive particles or the metal oxide particles include, but are not limited to, an ultrasonic disperser, a ball mill, a sand mill, and a homogenizing mixer.

[Step (2): Formation of Charge Generation Layer]

A charge generation layer can be formed in the following manner. A coating liquid (hereinafter, also referred to as "coating liquid for forming a charge generation layer") is prepared by dispersing a charge generation material in a solution obtained by dissolving a binder resin for charge generation layer in a solvent. Then, the coating liquid is applied onto the intermediate layer to form a coating film having a uniform layer thickness, and the coating film is dried to form a charge generation layer.

Examples of a method for applying the coating liquid for forming a charge generation layer include known methods such as immersion coating, spray coating, spinner coating, bead coating, blade coating, beam coating, slide hopper coating, and circular slide hopper coating.

A method for drying the coating film can be appropriately selected depending on the type of solvent used or the layer thickness, but is preferably heat drying.

Examples of the solvent used to form a charge generation layer include, but are not limited to, toluene, xylene, dichloromethane, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1-dioxane, 1,3-dioxolane, pyridine, and diethylamine.

Examples of a means for dispersing the charge generation material include, but are not limited to, an ultrasonic disperser, a ball mill, a sand mill, and a homogenizing mixer.

[Step (3): Formation of Charge Transport Layer]

A charge transport layer can be formed in the following manner. A coating liquid (hereinafter, also referred to as "coating liquid for forming a charge transport layer") is prepared by dissolving a binder resin for charge transport layer and a charge transport material in a solvent. Then, the coating liquid is applied onto the charge generation layer to form a coating film having a uniform layer thickness, and the coating film is dried to form a charge transport layer.

Examples of a method for applying the coating liquid for forming a charge transport layer include known methods such as immersion coating, spray coating, spinner coating, bead coating, blade coating, beam coating, slide hopper coating, and circular slide hopper coating.

A method for drying the coating film can be appropriately selected depending on the type of solvent used or the layer thickness, but is preferably heat drying.

Examples of the solvent used to form a charge transport layer include, but are not limited to, toluene, xylene, dichloromethane, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine.

[Step (4): Formation of Protective Layer]

A protective layer can be formed in the following manner. A polymerizable compound, metal oxide fine particles, a polymerization initiator, and if necessary, a specific radical scavenger and/or another component such as a charge transport material are added to a known solvent to prepare a coating liquid (hereinafter, also referred to as "coating liquid for forming a protective layer"), and the coating liquid for forming a protective layer is applied onto an outer periphery of the charge transport layer formed in the step (3) to form a coating film. Then, the coating film is dried and irradiated with actinic rays, such as ultraviolet rays or electron beams, to polymerize and cure the polymerizable compound component in the coating film to form a protective layer.

The types or amounts of the polymerizable compound, the metal oxide fine particles, and the polymerization initiator contained in the protective layer according to the present invention are appropriately set, and if necessary, the protective layer contains a specific radical scavenger to appropriately control a polymerization reaction so that the protective layer has a universal hardness of 220 to 280 $N/mm^2$.

Examples of a means for dispersing the metal oxide fine particles in the coating liquid for forming a protective layer include, but are not limited to, an ultrasonic disperser, a ball mill, a sand mill, and a homogenizing mixer.

Any solvent can be used to form a protective layer as long as the solvent can dissolve or disperse the polymerizable compound or the metal oxide fine particles or the like. Examples of such a solvent include, but are not limited to, methanol, ethanol, n-propyl alcohol, isopropyl alcohol, n-butanol, t-butanol, sec-butanol, benzyl alcohol, toluene, xylene, dichloromethane, methyl ethyl ketone, cyclohexane, ethyl acetate, butyl acetate, methyl cellosolve, ethyl cellosolve, tetrahydrofuran, 1-dioxane, 1,3-dioxolane, pyridine, and diethylamine.

Examples of a method for applying the coating liquid for forming a protective layer include known methods such as immersion coating, spray coating, spinner coating, bead coating, blade coating, beam coating, slide hopper coating, and circular slide hopper coating.

The coating liquid for forming a protective layer is preferably applied using a circular slide hopper coater. For example, the coating liquid for forming a protective layer can be applied by a method disclosed in JP 2015-114454 A.

Examples of a method for reacting the polymerizable compound include a method in which the polymerizable compound is reacted by electron-beam cleavage and a method in which the polymerizable compound is photopolymerized or heat-polymerized by adding a radical polymerization initiator. The radical polymerization initiator to be used may be either a photopolymerization initiator or a thermopolymerization initiator. Alternatively, a photopolymerization initiator and a thermopolymerization initiator may be used in combination.

The radical polymerization initiator is preferably a photopolymerization initiator, particularly preferably an alkylphenone-based compound or a phosphine oxide-based compound. Specifically, a compound having an α-hydroxyacetophenone structure or an acylphosphine oxide structure is preferred. These polymerization initiators may be used singly or in combination of two or more of them.

The ratio of the polymerization initiator to be added is preferably 0.1 to 20 parts by mass, more preferably 0.5 to 10 parts by mass per 100 parts by mass of all the monomers (polymerizable compound) for forming a cured resin component.

The cured resin component is formed by cure treatment in the following manner. The coating film is irradiated with actinic rays to generate radicals so that the polymerizable compound is polymerized and inter- and intramolecular cross-linking is performed by a cross-linking reaction to cure the polymerizable compound. The actinic rays are more preferably ultraviolet rays or electron beams, particularly preferably ultraviolet rays because of its ease of use.

As an ultraviolet source, any light source that generates ultraviolet rays can be used without limitation. Examples of such an ultraviolet source to be used include a low-pressure mercury lamp, a middle-pressure mercury lamp, a high-pressure mercury lamp, an ultrahigh-pressure mercury lamp, a carbon-arc lamp, a metal halide lamp, a xenon lamp, a flash (pulse) xenon lamp.

Irradiation conditions vary depending on the type of lamp used, but the dose of actinic rays is usually 5 to 500 $mJ/cm^2$, preferably 5 to 100 $mJ/cm^2$.

The electric power of the lamp is preferably 0.1 to 5 kW, particularly preferably 0.5 to 3 kW.

As an electron beam source, any electron beam irradiator can be used without limitation. Generally, a curtain beam-type electron beam irradiator that produces high power relatively inexpensively is effectively used as an electron beam accelerator for such electron beam irradiation. An accelerating voltage during electron beam irradiation is preferably 100 to 300 kV. An absorbed dose is preferably 0.5 to 10 Mrad.

Irradiation time to obtain a required dose of actinic rays is preferably 0.1 sec to 10 min and is, from the viewpoint of operation efficiency, more preferably 0.1 sec to 5 min.

In the step of forming a protective layer, drying can be performed before or after irradiation with actinic rays or during irradiation with actinic rays, and the timing of drying may be appropriately selected from combinations of them.

When a protective layer is formed using a specific radical scavenger, the ratio of the specific radical scavenger to be added to the coating liquid for forming a protective layer is preferably 1 to 30 parts by mass, more preferably 3 to 20 parts by mass per 100 parts by mass of all the monomers (polymerizable compound) for forming a cured resin component.

EXAMPLES

Hereinbelow, specific examples of the present invention will be described, but the present invention is not limited to these examples.

The structural formulas of compounds used in the examples are shown below.

[Chemical Formula 6]

Compound A

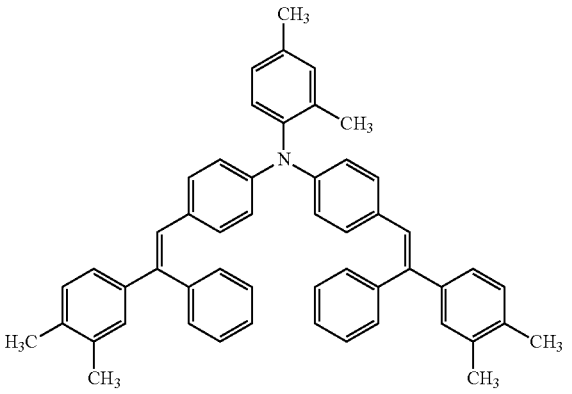

M1

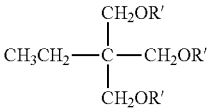

-continued

P1

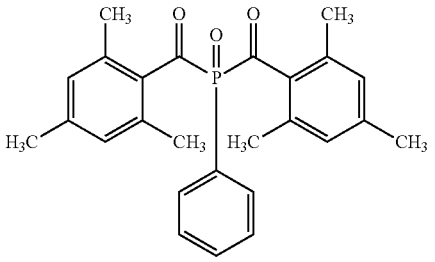

CTM-1

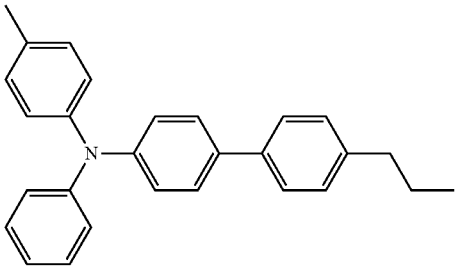

[Production of Organic Photoreceptor [1]]

(Preparation of Conductive Support)

The surface of a cylindrical aluminum support having a diameter of 100 mm was subjected to cutting work to prepare a conductive support [1] having a finely-roughened surface.

(Formation of Intermediate Layer)

A dispersion liquid having the following composition was diluted twice with the same mixed solvent and was allowed to stand overnight. Then, the dispersion liquid was filtered (filter: Rigimesh 5 μm filter manufactured by Nihon Pall Manufacturing Ltd.) to prepare a coating liquid for forming an intermediate layer [1].

Binder resin: Polyamide resin "CM8000" (manufactured by Toray Industries, Inc.) 1 part Metal oxide particles: Titanium oxide "SMT500SAS" (manufactured by TAYCA CORPORATION) 3 parts Solvent: Methanol 10 parts The coating liquid for forming an intermediate layer [1] was subjected to dispersion in a batch manner using a sand mill as a disperser for 10 hours. The coating liquid for forming an intermediate layer [1] was applied onto the conductive support [1] by immersion coating to form an intermediate layer [1] having a dry layer thickness of 2 μm.

(Formation of Charge Generation Layer)

First, 20 parts of a charge generation material (CG-1) that will be described later, 10 parts of a polyvinyl butyral resin "#6000-C" (manufactured by Denka Company Limited) as a binder resin, 700 parts of t-butyl acetate as a solvent, and 300 parts of 4-methoxy-4-methyl-2-pentanone as a solvent were mixed, and the resulting mixture was subjected to dispersion using a sand mill for 10 hours to prepare a coating liquid for forming a charge generation layer [1]. The coating liquid for forming a charge generation layer [1] was applied onto the intermediate layer [1] by immersion coating to form a charge generation layer [1] having a dry layer thickness of 0.3 μm.

(Synthesis of Charge Generation Material (CG-1)) (1) Synthesis of Amorphous Titanyl Phthalocyanine First, 29.2 parts by mass of 1,3-diiminoisoindoline was dispersed in 200 parts by mass of o-dichlorobenzene. Then, 20.4 parts by mass of titanium tetra-n-butoxide was added thereto, and the resulting mixture was heated at 150 to 160° C. for 5 hours in a nitrogen atmosphere. After cooling, deposited crystals were collected by filtration, washed with chloroform, a 2% aqueous hydrochloric acid solution, water, and methanol, and dried to obtain 26.2 parts by mass of crude titanyl phthalocyanine (yield: 91%).

Then, the crude titanyl phthalocyanine was dissolved in 250 parts by mass of concentrated sulfuric acid with stirring at 5° C. or lower for 1 hour, and 5000 parts by mass of water at 20° C. was poured thereinto. Deposited crystals were collected by filtration and sufficiently washed with water to obtain 225 parts by mass of a wet paste product.

The wet paste product was frozen in a freezer, again thawed, filtered, and dried to obtain 24.8 parts by mass of amorphous titanyl phthalocyanine (yield: 86%).

(2) Synthesis of Adduct of (2R,3R)-2,3-butanediol and Titanyl Phthalocyanine

First, 10.0 parts by mass of the amorphous titanyl phthalocyanine and 0.94 parts by mass of (2R, 3R)-2,3-butanediol (equivalent ratio: 0.6) (the equivalent ratio is an equivalent ratio to titanyl phthalocyanine, the same applies hereinafter) were mixed in 200 parts by mass of orthodichlorobenzene (ODB), and the resulting mixture was heated with stirring at 60 to 70° C. for 6.0 hours. After the mixture was allowed to stand overnight to obtain a reaction liquid, methanol was added to the reaction liquid to form crystals. The crystals were collected by filtration and then washed with methanol to obtain 10.3 parts by mass of CG-1 (charge generation material containing an adduct of (2R,3R)-2,3-butanediol and titanyl phthalocyanine).

In the X-ray diffraction spectrum of the charge generation material (CG-1), clear peaks appear at 8.3°, 24.7°, 25.1°, and 26.5°. In the mass spectrum of CG-1, peaks appear at 576 and 648. In the IR spectrum of CG-1, absorption peaks derived from Ti—O and O—Ti—O appear at about 970 $cm^{-1}$ and 630 $cm^{-1}$, respectively. In the thermal analysis (TG) of CG-1, a mass reduction of about 7% is observed at 390 to 410° C. From the result, it is estimated that CG-1 is a mixture of a 1:1 adduct of titanyl phthalocyanine and (2R, 3R)-2,3-butanediol and titanyl phthalocyanine in a non-adduct form. The BET specific surface area of the obtained charge generation material (CG-1) was measured using a fluid-type specific surface area automatic measuring device (Micrometrics FlowSorb manufactured by SHIMADZU CORPORATION), and was found to be 31.2 $m^2/g$.

(Formation of Charge Transport Layer)

First, 225 parts of the above compound A as a charge transport material, 300 parts of a polycarbonate resin "Z300" (manufactured by MITSUBISHI GAS CHEMICAL COMPANY, INC.) as a binder resin, 6 parts of "Irganox 1010" (manufactured by BASF Japan Ltd.) as an antioxidant, 1600 parts of THF (tetrahydrofuran) as a solvent, 400 parts of toluene as a solvent, and 1 part of silicone oil "KF-50" (manufactured by Shin-Etsu Chemical Co., Ltd.) were mixed and dissolved to prepare a coating liquid for forming a charge transport layer [1].

The coating liquid for forming a charge transport layer [1] was applied onto the charge generation layer [1] using a circular slide hopper coater to form a charge transport layer [1] having a dry layer thickness of 20 μm.

(Formation of Protective Layer)

First, 125 parts of tin oxide fine particles [1], which will be described later, as metal oxide fine particles, 100 parts of the above exemplary compound (M1) as a polymerizable compound, 7 parts of the above exemplary compound (P1) as a polymerization initiator, and 7 parts of "SUMILIZER GS ($R_1$ and $R_2$ in the above general formula (1) are each a tert-pentyl group)" as a radical scavenger, 200 parts of 2-butanol as a solvent, and 50 parts of tetrahydrofuran as a solvent were mixed with stirring to sufficiently dissolved and disperse them to prepare a coating liquid for forming a protective layer [1]. The coating liquid for forming a protective layer [1] was applied onto the charge transport layer [1] using a circular slide hopper coater to form a coating film, and the coating film was irradiated with ultraviolet rays for 1 minute using a metal halide lamp to form a protective film having a dry layer thickness of 4.0 μm. At this time, the protective layer had a universal hardness of 280 $N/mm^2$.

(Preparation of Tin Oxide Fine Particles [1])

Tin oxide [1], which will be described later, was used as untreated metal oxide fine particles and surface-modified in the following manner using the above exemplary compound (S-15) as a surface modifier to prepare tin oxide fine particles [1].

First, tin oxide manufactured by CIK NanoTek Corporation (number-average primary particle diameter: 20 nm, volume resistivity: $1.05\times10^5$ (Ω·cm) was prepared as tin oxide [1].

Then, a mixture of 100 parts of the tin oxide [1], 30 parts of a surface modifier (exemplary compound (S-15): $CH_2{=}C(CH_3)COO(CH_2)_3Si(OCH_3)_3$), and 300 parts of a 1:1 (mass ratio) mixed solvent of toluene/isopropyl alcohol was put into a sand mill together with zirconia beads and stirred at about 40° C. and a rotation speed of 1500 rpm to perform surface modification. Further, the treated mixture was taken out of the sand mill, put into a Henschel mixer, stirred at a rotation speed of 1500 rpm. for 15 minutes, and dried at 120° C. for 3 hours to complete the surface modification. In this way, surface modified-tin oxide fine particles [1] were prepared.

[Production of Organic Photoreceptors [2] to [9]]

Organic photoreceptors [2] to [9] were produced in the same manner as the organic photoreceptor [1] except that the amounts of the polymerizable compound (M1), the polymerization initiator (P1), the radical scavenger (SUMILIZER GS), the tin oxide fine particles [1], and the charge transport material (CTM-1) added to form a protective layer were changed as shown in Table 1.

The universal hardness of the surface of each of the organic photoreceptors [2] to [9] was measured in the same manner as the organic photoreceptor [1]. Measurement results are shown in the following Table 1.

[Production of Cleaning Blade [1]]

A molding die drum of a known centrifugal molding machine (inner diameter: 700 mm, depth: 500 mm, run-out accuracy at ordinary temperature: 0.06 mm, rotation speed during molding: 800 rpm, surface roughness: Ra=0.30) was heated to 40° C., and a mixture of an addition cure-type silicone rubber composition "TSE3032 (A) " (main agent, manufactured by GE Toshiba Silicones) that is cured by an addition reaction and "TSE3032(B)" (curing agent) (mixing ratio by mass: 10:1) was poured as a silicone rubber material into the molding die drum and cured by heating for 120 minutes to form a silicone rubber layer [1].

A blade material "polyurethane" (hardness:)68°) was poured onto the silicone rubber layer [1] in the die of the centrifugal molding machine preheated to 140° C. and cured for 30 minutes. After the curing reaction, only the sheet-shaped elastic rubber member was taken out of the die to obtain a cylindrical sheet having a thickness of 2.00 mm. The cylindrical sheet was cut to obtain a strip-shaped member having a width of 14 mm and a length of 364 mm as a blade member [1].

The obtained blade member [1] was bonded to a support member made of plated steel with a polyurethane-based hot-melt adhesive to produce a cleaning blade [1]. The blade member [1] corresponds to the cured layer described in the present invention, and is a portion to be abutted on the photoreceptor.

[Production of Cleaning Blade [2]]

A cleaning blade [2] was produced in the same manner as in the production example of the cleaning blade [1] except that "polyurethane" having a hardness of 70° was used as a blade material.

[Production of Cleaning Blade [3]]

A cleaning blade [3] was produced in the same manner as in the production example of the cleaning blade [1] except that "polyurethane" having a hardness of 74° was used as a blade material.

[Production of Cleaning Blade [4]]

A cleaning blade [4] was produced in the same manner as in the production example of the cleaning blade [1] except that "polyurethane" having a hardness of 78° was used as a blade material.

[Production of Cleaning Blade [5]]

A cleaning blade [5] was produced in the same manner as in the production example of the cleaning blade [1] except that "polyurethane" having a hardness of 80° was used as a blade material.

The hardness (JIS-A hardness) of each of the cleaning blades [1] to [5] is shown in Table 2.

TABLE 1

| Photoreceptor No. | Tin Oxide Fine Particles [parts] | Polymerizable Compound [parts] | Polymerization Initiator [parts] | Radical Scavenger [parts] | Charge Transport Material [parts] | Universal Hardness of Protective Layer [$N/mm^2$] |
|---|---|---|---|---|---|---|
| 1 | 125 | 100 | 7 | 7 | 0 | 280 |
| 2 | 145 | 100 | 8 | 8 | 15 | 260 |
| 3 | 140 | 100 | 8 | 19 | 0 | 240 |
| 4 | 150 | 100 | 8 | 13 | 16 | 240 |
| 5 | 160 | 100 | 9 | 21 | 17 | 220 |
| 6 | 145 | 100 | 8 | 23 | 0 | 220 |
| 7 | 155 | 100 | 8 | 0 | 33 | 240 |
| 8 | 120 | 100 | 6 | 3 | 0 | 300 |
| 9 | 170 | 100 | 9 | 27 | 18 | 200 |

TABLE 2

| Cleaning Blade No. | Hardness [°] |
|---|---|
| 1 | 68 |
| 2 | 70 |
| 3 | 74 |
| 4 | 78 |
| 5 | 80 |

[Evaluations]

A combination of one of the produced photoreceptors [1] to [9] and one of the produced cleaning blades [1] to [5] shown in the following Table 3 was installed in an image forming apparatus "bizhub PRO 1250" (manufactured by KONICA MINOLTA JAPAN, INC.). In this way, image forming apparatuses [1] to [12] were prepared.

An A4-size image having a coverage rate of 5% was printed on 500000 sheets of neutralized paper by each of the image forming apparatuses [1] to [12] at 20° C. and 50% RH, and then each of the photoreceptors was evaluated in terms of image quality (raindrop-like spots, image deletion, and slipping-through of toner) in the following manner.

It is to be noted that zinc stearate "ZnSt-S" (manufactured by NOF CORPORATION, average primary particle diameter: 10 μm) was externally added as a fine powdery lubricant to toner used for image formation, and the lubricant was supplied onto the surface of the photoreceptor by action of a development field formed in a developing section in a developing step.

The cleaning blade was disposed so as to abut on the surface of the photoreceptor at an inclination angle of 12° and a linear pressure of 20 N/m.

(Evaluation of Raindrop-Like Spots)

A band chart image (band area: 100 [%] solid) having a width of 40 mm was printed on 1000 sheets of paper under conditions of 10° C. and 15% RH, and then the image printed on the 1000th sheet of paper was visually observed to determine the size and number of raindrop-like spots formed in the band area having a width of 40 mm and a length of 314 mm corresponding to one cycle of rotation of the photoreceptor, and was evaluated according to the following criteria.

⊙: No raindrop-like spot is formed (acceptable).

○: One or more but five or less raindrop-like spots having a size of less than 1 mm are formed, and no raindrop-like spot having a size of 1 mm or more is formed (acceptable).

×: Six or more raindrop-like spots having a size of less than 1 mm are formed, or one or more raindrop-like spots having a size of 1 mm or more are formed (unacceptable).

(Evaluation of Image Deletion)

An A4-size image having a coverage rate of 5% was printed on 1000 sheets of neutralized paper under conditions of 30° C. and 80% RH, and then a main power supply of the image forming apparatus was immediately turned off. After 12 hours from the turn-off of the main power supply, the main power supply was turned on. After the image forming apparatus became a printable state, a halftone image (relative reflection density measured with a Macbeth densitometer: 0.4) and a 6-dot lattice image were immediately printed on the entire surface of A3-size neutralized paper. The printed images were visually observed and evaluated according to the following criteria.

⊙: No image deletion occurs in both the halftone image and the lattice image (acceptable).

○: A reduction in density is slightly observed in a band-shaped area along the longitudinal direction of the photoreceptor only in the halftone image (acceptable).

×: An image defect or a reduction in line width due to image deletion occurs in the lattice image (unacceptable).

(Evaluation of Slipping-Through of Toner)

A halftone image (coverage: 80[%]) was printed on the entire surface of A3-size 100 sheets of neutralized paper under conditions of 10° C. and 15% RH, and a white background was visually observed and evaluated according to the following criteria.

○: Slipping-through of toner does not occur (acceptable).

×: Slipping-through of toner occurs (unacceptable).

TABLE 3

| | Photoreceptor | | Cleaning Blade | | Evaluation Items | | | |
|---|---|---|---|---|---|---|---|---|
| Image Forming Apparatus No. | No. | Universal Hardness of Protective Layer [N/mm$^2$] | No. | Hardness [°] | Image Deletion | Raindrop-Like Spots | Slipping-through of Tonar | Remarks |
| 1 | [1] | 280 | [4] | 78 | ○ | ⊙ | ○ | Example |
| 2 | [2] | 260 | [2] | 70 | ○ | ⊙ | ○ | Example |
| 3 | [3] | 240 | [4] | 78 | ⊙ | ⊙ | ○ | Example |
| 4 | [4] | 240 | [3] | 74 | ⊙ | ⊙ | ○ | Example |
| 5 | [5] | 220 | [4] | 78 | ⊙ | ○ | ○ | Example |
| 6 | [6] | 220 | [2] | 70 | ○ | ○ | ○ | Example |
| 7 | [7] | 240 | [3] | 74 | ○ | ⊙ | ○ | Example |
| 8 | [8] | 300 | [3] | 74 | X | ⊙ | ○ | Comparative Example |
| 9 | [8] | 300 | [1] | 68 | X | ⊙ | ○ | Comparative Example |
| 10 | [9] | 200 | [3] | 74 | ⊙ | X | ○ | Comparative Example |
| 11 | [3] | 240 | [5] | 80 | ⊙ | ⊙ | X | Comparative Example |
| 12 | [4] | 240 | [1] | 68 | ○ | X | ○ | Comparative Example |

As can be seen from the results shown in Table 3, the image forming apparatus according to the present invention can effectively prevent the occurrence of raindrop-like spots, image deletion, and slipping-through of toner even after continuously performing image formation on 500000 sheets of paper, and can maintain high cleanability for the long term.

According to an embodiment of the present invention, it is possible to provide an electrophotographic image forming apparatus that can prevent the occurrence of image deletion, raindrop-like spots, and slipping-through of toner and can maintain cleanability for the long term.

The occurrence mechanism of the effects of the present invention and the action mechanism of the present invention are not clear, but are supposed as follows.

The protective layer containing metal oxide fine particles in a cured resin is excellent in wear resistance, and therefore can prolong the lifetime of the photoreceptor. However, surface resistance is reduced by adhesion of a discharge product or the like so that image deletion is likely to occur. For this reason, it is always necessary to refresh the surface of the photoreceptor.

The protective layer as a surface of the photoreceptor according to the present invention has an appropriate universal hardness and an appropriate film strength (wear resistance). Further, the photoreceptor having such a protective layer and the cleaning blade having a hardness appropriate to the hardness of the protective layer are combined to constitute the image forming apparatus. This makes it possible to achieve an appropriate amount of wear of the protective layer when the surface of the photoreceptor is refreshed, which is considered to be the reason why the occurrence of image deletion, raindrop-like spots, and slipping-through of toner can be prevented and cleanability can be maintained for the long term.

More specifically, the protective layer as a surface of the photoreceptor has a universal hardness (HU) as high as 220 $N/mm^2$ or more, and the cleaning blade to be used has an appropriate JIS-A hardness of 70 to 78°. Therefore, the amount of bite of the cleaning blade is small so that the cleaning blade is less likely to stick. This makes it possible to effectively prevent slipping-through of toner so that cores that cause raindrop-like spots are less likely to be formed, which is considered to be the reason why the occurrence of raindrop-like spots can be prevented.

If the universal hardness (HU) of the protective layer as a surface of the photoreceptor is excessively high, a discharge product or paper dust accumulated on the surface of the protective layer and a hydrophilic deteriorated layer formed by oxidation of the outermost surface of the protective layer cannot be removed by the cleaning blade so that image deletion occurs. The universal hardness (HU) of the surface of the photoreceptor according to the present invention is set to 280 $N/mm^2$ or less so as not to be excessively high, which is considered to be the reason why the occurrence of image deletion can be prevented.

If the JIS-A hardness of the cleaning blade is excessively high, scratches (surface irregularities) are formed on the surface of the photoreceptor, which makes the contact between the blade and the surface of the photoreceptor poor. As a result, slipping-through of toner occurs. The JIS-A hardness of the cleaning blade according to the present invention is set to 78° or less so as not to be excessively high so that scratches (irregularities) are less likely to be formed on the surface of the photoreceptor, which is considered to be the reason why slipping-through of toner can be effectively prevented.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An electrophotographic image forming apparatus comprising:

an organic photoreceptor in which at least a charge generation layer, a charge transport layer, and a protective layer are laminated in order on a conductive support, a unit for supplying a lubricant onto a surface of the organic photoreceptor, and a unit for removing toner remaining on the surface of the organic photoreceptor with a cleaning blade, wherein the following conditions (1) to (3) are satisfied:

(1) the protective layer of the organic photoreceptor contains at least metal oxide fine particles in a cured resin obtained by curing a polymerizable compound;

(2) a universal hardness of the surface of the organic photoreceptor is in a range of 220 to 280 $N/mm^2$; and (3) a JIS-A hardness of a portion of the cleaning blade to be abutted on the organic photoreceptor is in a range of 70 to 78°.

2. The electrophotographic image forming apparatus according to claim 1, wherein the protective layer contains a radical scavenger having a structure represented by the following general formula (1):

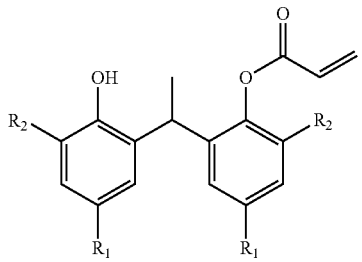

wherein $R_1$ and $R_2$ are each an alkyl group having 1 to 6 carbon atoms.

3. The electrophotographic image forming apparatus according to claim 1, wherein the cleaning blade abuts on the organic photoreceptor at an angle of 5 to 20° and a linear pressure of 13 to 24 N/m.

4. The electrophotographic image forming apparatus according to claim 1, wherein the lubricant contains zinc stearate.

5. The electrophotographic image forming apparatus according to claim 1, wherein the unit for supplying the lubricant is a unit for supplying, to the organic photoreceptor, a fine powdery lubricant externally added to the toner by action of a development field formed by a unit for forming a toner image.

* * * * *